US008183760B2

(12) United States Patent
Speer et al.

(10) Patent No.: US 8,183,760 B2
(45) Date of Patent: May 22, 2012

(54) COILS FOR ELECTRON DISCHARGE DEVICES

(75) Inventors: Richard Speer, Concord, MA (US); Stuart Denham, Nottingham, NH (US); Henry Hall, Dover, NH (US); Brian Jones, Lexington, KY (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 12/815,960

(22) Filed: Jun. 15, 2010

(65) Prior Publication Data

US 2011/0304259 A1 Dec. 15, 2011

(51) Int. Cl.
*H01J 63/04* (2006.01)

(52) U.S. Cl. ..... 313/491

(58) Field of Classification Search ..... 313/491, 313/483–490

See application file for complete search history.

(56) References Cited

U.S. PATENT DOCUMENTS

| | | | | | |
|---|---|---|---|---|---|
| 3,909,583 | A * | 9/1975 | Petro et al. | ..... | 219/121.67 |
| 4,352,043 | A * | 9/1982 | Rigden | ..... | 315/1 |
| 4,918,356 | A * | 4/1990 | Enyedy et al. | ..... | 313/579 |
| 5,173,632 | A * | 12/1992 | Dolan et al. | ..... | 313/25 |
| 5,404,069 | A * | 4/1995 | Olwert et al. | ..... | 313/279 |
| 5,785,731 | A * | 7/1998 | Fait et al. | ..... | 75/368 |

* cited by examiner

*Primary Examiner* — Toan Ton
*Assistant Examiner* — Hana Featherly
(74) *Attorney, Agent, or Firm* — Robert F. Clark; Andrew Martin

(57) ABSTRACT

A mount (30) for a fluorescent lamp (32) has a glass flare (34) with a first portion (36) penetrating the fluorescent lamp (32) and a second portion (38) the fluorescent lamp (32). Two spaced-apart lead-in wires (40, 42) are sealed in the glass flare (34): and an electron emitter (12) is fixed between the spaced-apart lead-in wires (40, 42) and mated thereto by an electrical connection (46). The electron emitter (12) comprises a substrate (10) of a first material having an electron emitting material (11) thereon and two ends (20,22) and an element (23) mechanically and electrically fixed to each of the ends (20, 22), the element (23) comprising a second material different from the first material and is used to make the electrical connection (46) between the ends (20, 22) and the lead-in wires (40, 42).

4 Claims, 4 Drawing Sheets

COILS FOR ELECTRON DISCHARGE DEVICES

TECHNICAL FIELD

This invention relates to coils for electron discharge devices and more particularly to coils for fluorescent lamps. Still more particularly the invention relates to coils that attach readily and more efficiently to the electrical lead-ins of the lamp.

BACKGROUND ART

The electron source for fluorescent lamps comprises a coiled coil of one or more thin tungsten wires surrounded by an electron emitting material including barium oxide and, usually, one or more of the oxides of calcium and strontium. These materials are applied as the carbonates and, during a subsequent activation process, the carbonates are converted to carbon dioxide (which is pumped away) and the oxides, which remain on the coil. Under current manufacturing techniques, the coils are prepared in a length that is slightly longer than the effective length of the coil and the coil is mounted between two electrical lead-ins by crimping the ends of the coils between folded-over ends of the lead-ins. This crimp joint has proven to be surprisingly inconsistent in its electrical and mechanical integrity. This inconsistency causes variations in the cold resistance (Rc) of the joint and the Rc is one of the controlled parameters in the coils' specifications. For example, this property of the mount assembly (i.e., the crimp) greatly influences the process temperatures achieved during the afore-mentioned activation process, which results in large variation in the quality of the electrode thermo-chemical process and, thus, the efficiency of the coil and of the lamp in which it is employed. Another problem can arise if the coating suspension on the coil wicks out of the coil and into a portion of the crimp joint that contacts the lead-in wires. That condition can result in carbonate powders that do not reach a high enough temperature to decompose during the activation process. When that situation occurs contamination of the lamp can result. It has been proposed that the latter situation can be prevented by masking the ends of the coil during the coating operation so that only the bare ends of the coil are captured by the crimp joint. However, not only does that operation increase the cost of making the coils, it has been discovered that during the early stages of the activation process, these bare coil segments heat up much faster than the coated sections and, in some cases of high resistance and elevated temperatures (which can reach >2100 ° C.), can result in recrystallization of the tungsten wire, a condition that weakens the coil and can cause premature failure of the lamp in which it is employed. Accordingly, correcting these situations would provide an advance in the art and greatly improve the life of the lamps in which they are used.

SUMMARY OF INVENTION

It is, therefore, an object of the invention to obviate the above enumerated disadvantages of the prior art.

It is another object of the invention to enhance the operation of lamps employing coiled electron discharge sources.

Yet another object of the invention is the improvement of mounting methods for such coils.

These object are accomplished, in one aspect of the invention, by the provision of a substrate for an electron emitter that comprises a coil comprised of one or more wires of a first material and having a length and a diameter and two ends, and an element mechanically and electrically fixed to each of the ends, the element comprising a second material different from the first material and being of a size to allow the coil to subsequently be mounted between spaced-apart lead-in wires by utilizing the element.

In a first embodiment of the invention the element can be a solid ball having a diameter substantially equal to the coil diameter and in a second embodiment the element can be a length of molybdenum or steel wire. In the first embodiment connection of the coil to the lead-in wires is preferably accomplished by welding. In the second embodiment either welding or the more or less conventional crimping can be used. The use of any of the techniques described herein provides improved coils and lamps by eliminating or reducing at least some of the problems described above.

DETAILED DESCRIPTION THE INVENTION

Figure 1:
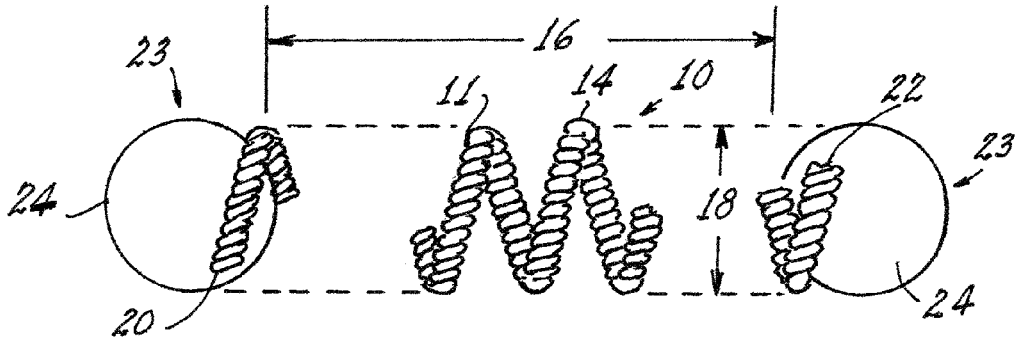
FIG. 1 is a diagrammatic illustration of a coil utilizing an embodiment of the invention.
Figure 2:
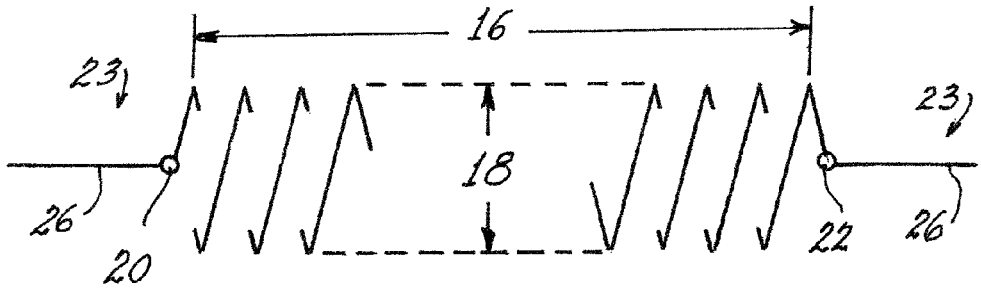
FIG. 2 is a schematic view of an alternate embodiment of the invention.

For purposes of this application it is to be understood that when an element or layer is referred to as being "on," "connected to" or "coupled to" another element or layer, it can be directly on, connected to or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. The term "and/or" includes any and all combinations of one or more of the associated listed items.

Although the terms "first," "second," "third" etc. may be used to describe various elements, components, regions, layers and/or sections, these elements, components, regions, layers and/or sections are not to be limited by theses terms as they are used only to distinguish one element, component, region, layer and/or section from another element, component, region, layer and/or section. Thus, a first element, component, region, layer or section could be termed a second element, component, region, layer or section without departing from the scope and teachings of the present invention.

Spatially relative terms, such as "beneath," "below," "upper," "lower," "above" and the like may be used herein for ease of description to describe one element or feature's relationship to another element(s) or feature(s) as illustrated in the drawings. These spatially relative terms are intended to encompass different orientations of the device in use or operation in addition to the orientation shown in the drawings. For example, if the device in the drawings is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. For example, as used herein, the singular forms "a," "an" and "the" are intended to include the plural forms as well, unless the context clearly indicates otherwise. It will be further understood that the terms, "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

For a better understanding of the present invention, together with other and further objects, advantages and capabilities thereof, reference is made to the following disclosure and appended claims taken in conjunction with the above-described drawings.

Referring now to the drawings with greater particularity there is shown in FIG. 1 a substrate 10 for an electron emitter 12 comprising a coil 14 comprised of a first material and having a length 16 and a diameter 18 and two ends 20, 22. The coil 14 is preferably a coiled coil having a primary winding and a secondary winding. As is conventional, the primary and secondary coils can be wound on fugitive mandrels that are subsequently removed by a suitable acid bath. Commonly employed fugitive materials include steel and molybdenum. Other materials that would not interfere with the operation of the coil can also be used. An element 23 is mechanically and electrically fixed to each of the ends 20, 22, and comprises a second material different from the first material and being of a size to allow the coil 14 to subsequently be mounted between spaced-apart lead-in wires 40, 42 by utilizing the element 23.

In a first embodiment of the invention the coil 14 is tungsten and the element 23 comprises a solid ball 24 having a diameter at least equal to the major coil diameter 18, the ball 24 being comprised of a composite of tungsten and the fugitive mandrel. In a preferred embodiment the second material is steel. As used herein the term "ball" is not to be taken as meaning an object exhibiting absolute sphericity, since substantial distortion from absolute sphericity will not have a negative effect on its use. For example, the coil can have a length of 11 mm and the ball 24 can have a length of at least 0.75 mm that can substantially mimic the diameter 18.

In a second embodiment the element 23 can comprise a length of molybdenum wire 26, which is welded to the ends of the coil 14. In practice, the molybdenum wire 26 can be positioned with coil ends and heated by a laser, which operation will melt the molybdenum wire 26 and allow the melted molybdenum to wick into the coil to establish the necessary electrical and mechanical connection.

In yet another embodiment of the invention, a portion of the secondary steel mandrel can remain as a part of the coil, the steel remnant substituting for the molybdenum wire and being used for fixing the coil to the lead-in wires.

Figure 3:
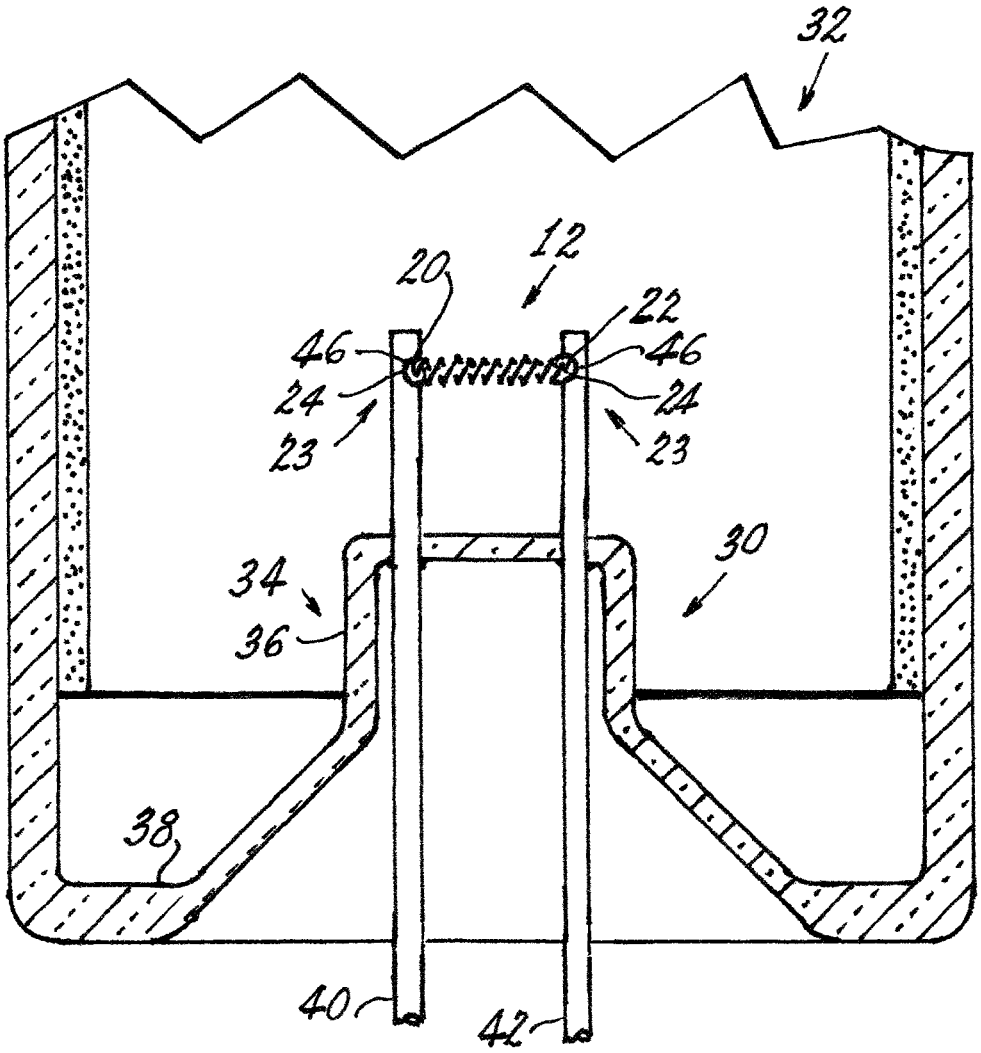
FIG. 3 is a partial, sectional view of an embodiment of the invention employed in a fluorescent lamp.
Figure 4:
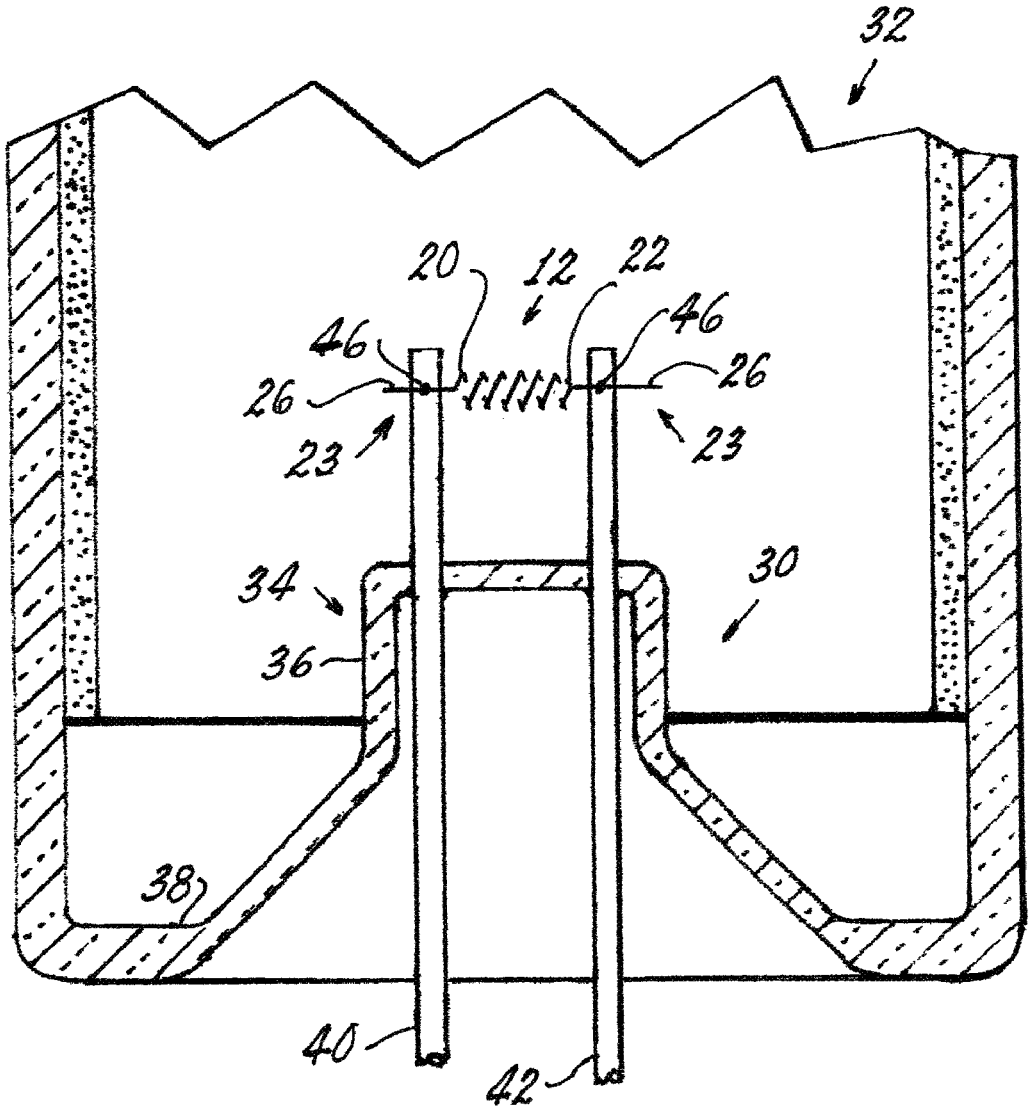
FIG. 4 is a view similar to FIG. 3 of an additional embodiment of the invention.

Referring now to FIGS. 3 and 4 there is shown a mount 30 for a fluorescent lamp 32 that comprises a glass flare 34 having a first portion 36 penetrating the fluorescent lamp 32 and a second portion 38 that seals the end of the fluorescent lamp 32. Two spaced-apart lead-in wires 40, 42 are sealed in the glass flare 34 and an electron emitter 12 is fixed between the spaced-apart lead-in wires 40, 42 and mated thereto by an electrical connection 46. The electron emitter comprises the substrate 10, the coil 14 and the electron emissive material encompassed within the turns of the coil 14, the two ends 20, 22 and an element 23 mechanically and electrically fixed to each of the ends 20, 22, the element 23 comprising a second material different from the coil material.

In the embodiment shown in FIG. 3 the element 23 is a ball 24 comprised of a composite of tungsten and the fugitive mandrel, in this case, steel. Electrical connection to the lead-in wires 40, 42 is made by welding the ball 24 thereto. Utilizing the substantially steel ball 24 allows welding to occur at much lower temperatures.

In the embodiment shown In FIG. 4 the element 23 comprises a length of molybdenum wire 26 that is welded to the lead-in wires 40, 42. In the event that molybdenum has been used as the fugitive mandrel, the length of molybdenum wire 26 can be a remnant of the mandrel itself.

Figure 5:
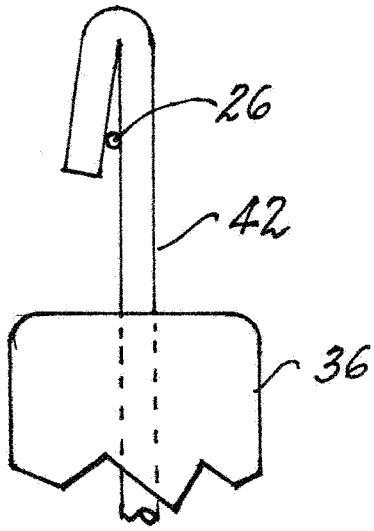
FIG. 5 is a partial view of yet another alternate embodiment of the invention.

Alternatively, as shown in FIG. 5, when the element 23 comprises the length of molybdenum wire 26 (or, alternatively, a portion of the steel or molybdenum mandrel), attachment to the lead-in wires 40, 42 can be made by crimping. The difference between this crimping process and the prior art crimping process is that no turns of the coil 14 are involved; thus eliminating the problem of the coating suspension wicking out of the coil 14 and into that portion of the crimp joint that contacts the lead-in wires. Also, since no turns of the coil 14 are involved in the crimp much greater pressures can be used, thus reducing further any variations in the Rc.

Thus there are provide numerous techniques for improving coils for fluorescent lamps and emitter coils generally. Excess tungsten outside of the crimp area is eliminated, reducing the material requirements. The emissive coating cannot wick into the crimp, if a crimp joint is used and cannot wick into the weld area. Bare sections of coil are eliminated, avoiding the risk of re-crystallization during processing and increasing the amount of emitter material that can be used, increasing the life of lamps. Reduced variation in the Rc of the mounts contributes to increased life and more consistent performance. Also, the length of the mount 30 is reduced, which can help in the incorporation of shields around the emitter. Such shields are occasionally employed to prevent end blackening of the fluorescent lamps due to the deposition of evaporated tungsten that comes from the coils during operation of the lamps.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A substrate (10) for an electron emitter (12) comprising:

a coil (14) comprised of a first material and having a length (16) and a diameter (18) and two ends (20, 22); and an element (23) mechanically and electrically fixed to each of said ends (20, 22), said element (23) comprising a second material different from said first material and being of a size to allow said coil (14) to subsequently be mounted between spaced-apart lead-in wires (40, 42) by utilizing said element (23) wherein said element (23) comprises a solid ball (24) having a diameter substantially equal to said coil diameter (18) and each said element (23) directly electrically couples said spaced-apart lead wires (40, 42) to said coil (14).

2. The substrate (10) of claim 1 wherein said substrate (10) is comprised substantially of tungsten and said balls (24) comprise a composite of tungsten and steel.

3. The substrate (10) of claim 1 wherein said element (23) comprises a length of wire (26) selected from molybdenum or steel.

4. A substrate for an electron emitter comprising:

a coil comprised of a first material and having a length and a diameter and two ends; and an element mechanically and electrically fixed via crimp connection to each of said ends, said element comprising a second material different from said first material and being of a size to allow said coil to subsequently be mounted between spaced-apart lead-in wires by utilizing said element wherein said element comprises a solid ball having a diameter substantially equal to said coil diameter and each said element provides a direct electrical connection between said spaced-apart lead wires and said coil.

* * * * *